US007537084B2

(12) United States Patent
Buckley

(10) Patent No.: US 7,537,084 B2
(45) Date of Patent: May 26, 2009

(54) DISCHARGE GAS CHECK VALVE INTEGRAL WITH MUFFLER

(75) Inventor: Michael Lee Buckley, Abbottstown, PA (US)

(73) Assignee: York International Corporation, York, PA (US)

( * ) Notice: Subject to any disclaimer, the term of this patent is extended or adjusted under 35 U.S.C. 154(b) by 300 days.

(21) Appl. No.: 11/217,566

(22) Filed: Sep. 1, 2005

(65) Prior Publication Data

US 2006/0048996 A1 Mar. 9, 2006

Related U.S. Application Data

(60) Provisional application No. 60/607,413, filed on Sep. 3, 2004.

(51) Int. Cl.
*F01N 1/08* (2006.01)

(52) U.S. Cl. ..... 181/269; 181/237; 181/212

(58) Field of Classification Search ..... 181/230, 181/237, 269; 138/220, 51.3, 514.5, 514.7; 137/220, 513.3, 514.5, 514.7
See application file for complete search history.

(56) References Cited

U.S. PATENT DOCUMENTS

| | | | | | |
|---|---|---|---|---|---|
| 631,370 | A | * | 8/1899 | Hughes | 181/237 |
| 1,990,249 | A | * | 2/1935 | Pieron | 181/278 |
| 2,646,071 | A | * | 7/1953 | Wagner | 137/528 |
| 4,250,916 | A | * | 2/1981 | Hoffmann | 137/514.5 |
| 4,903,486 | A | * | 2/1990 | Finkle | 60/324 |
| 4,904,165 | A | | 2/1990 | Fraser, Jr. et al. | |
| 5,141,420 | A | | 8/1992 | Nambiar | |
| 5,208,429 | A | * | 5/1993 | Field | 181/229 |
| 5,385,453 | A | | 1/1995 | Fogt et al. | |
| 5,516,267 | A | | 5/1996 | Ikeda et al. | |
| 5,583,325 | A | * | 12/1996 | Schutte et al. | 181/237 |
| 5,683,236 | A | | 11/1997 | Harrison et al. | |
| 6,065,564 | A | * | 5/2000 | Uegane | 181/237 |
| 6,171,084 | B1 | * | 1/2001 | Wallis et al. | 418/55.1 |
| 6,220,839 | B1 | | 4/2001 | Sheridan et al. | |
| 6,338,246 | B2 | * | 1/2002 | Eguchi et al. | 60/324 |
| 6,422,842 | B2 | | 7/2002 | Sheridan et al. | |
| 6,428,292 | B1 | * | 8/2002 | Wallis et al. | 418/55.1 |
| 6,488,482 | B1 | | 12/2002 | Yannascoli et al. | |

(Continued)

OTHER PUBLICATIONS

Moon-Joo Lee, Sung-Hae Cho, Chun-Mo Sung, Seung-Kap Lee, Development of a Variable Capacity Rotary Compressor Part I: Design Concepts and Experimental Evaluation Results, Samsung Electronics Co., C113, p. 1, Korea.

(Continued)

*Primary Examiner*—Jeffrey Donels
*Assistant Examiner*—Forrest M Phillips
(74) *Attorney, Agent, or Firm*—McNees Wallace & Nurick, LLC

(57) ABSTRACT

A compressor muffler includes a housing having an inlet end and an outlet end. A baffle arrangement extends from an interior surface of the housing. The baffle arrangement includes a surface capable of reflecting compressed fluid to attenuate noise. A valve assembly is disposed inside the baffle arrangement. The valve assembly is positionable between a first position and a second position. The valve assembly also includes a valve surface that at least partially prevents flow of fluid through the housing from the outlet end when the valve assembly is in the first position.

15 Claims, 7 Drawing Sheets

U.S. PATENT DOCUMENTS

| | | | | |
|---|---|---|---|---|
| 6,582,211 | B2 * | 6/2003 | Wallis et al. | 418/55.1 |
| 6,823,686 | B2 | 11/2004 | Chumley et al. | |
| 2002/0005318 | A1 * | 1/2002 | Schumacher et al. | 181/237 |
| 2002/0187062 | A1 * | 12/2002 | Wallis et al. | 418/55.1 |
| 2006/0048996 | A1 * | 3/2006 | Buckley | 181/269 |
| 2006/0213719 | A1 * | 9/2006 | Schlussler et al. | 181/237 |

OTHER PUBLICATIONS

Jeong-Bae Lee, Seung-Kap Lee, Chun-Mo Sung, Jae-Woo Park, Development of a Variable Capacity Rotary Compressor Part II: Design of Reliable Clutching Mechanism, Samsung Electronics Co., C114, p. 1, Korea.

* cited by examiner

DISCHARGE GAS CHECK VALVE INTEGRAL WITH MUFFLER

FIELD OF THE INVENTION

The present invention relates to HVAC systems having a compressor component. More specifically, the present invention relates to a discharge muffler arrangement for a compressor.

BACKGROUND OF THE INVENTION

A standard refrigeration or HVAC system includes a refrigerant fluid, an evaporator, a compressor, a condenser, and an expansion valve. In a typical refrigeration cycle, the refrigerant fluid begins in a liquid state under low pressure. The evaporator evaporates the low pressure liquid, and the liquid becomes a low pressure vapor. The compressor draws the vapor in and compresses it, producing a high pressure vapor. The compressor then passes the high pressure vapor to the condenser. The condenser condenses the high pressure vapor, generating a high pressure liquid. The cycle is completed when the expansion valve expands the high pressure liquid, resulting in a low pressure liquid. By means of example only, the refrigerant fluid may include the any suitable refrigerant including, but not limited to R-410A, R-407C, ammonia, or ethyl chloride.

A primary component in HVAC systems is a positive displacement compressor, which receives a cool, low pressure gas and by virtue of a compression device that may include one or more compression members, exhausts a hot, high pressure gas. One type of positive displacement compressor is a screw compressor, which generally includes two cylindrical rotor compression members mounted on separate shafts inside a hollow, double-barreled casing. The side-walls of the compressor casing typically form two parallel, overlapping cylinders which house the rotors side-by-side, with their shafts parallel to the ground. Screw compressor rotors typically have helically extending lobes and grooves on their outer surfaces forming a large thread on the circumference of the rotor, also referred to as an involute surface. During operation, the threads of the rotors mesh together, with the lobes on one rotor meshing with the corresponding grooves on the other rotor to form a series of gaps between the rotors. These gaps form a continuous compression chamber that communicates with the compressor inlet opening, or "port," at one end of the casing, continuously reduces in volume as the rotors turn to compress the gas, and exhausts the compressed gas at a discharge port at the opposite end of the casing for use in the system.

The screw compressor creates a significant amount of noise. To mediate the noise produced by the compressor, a muffler may be installed on the discharge of the compressor. One type of muffler utilizes a baffle inside the muffler body to reduce noise. The baffle includes a surface substantially perpendicular to the flow of fluid. The fluid entering the muffler is reflected off the baffle. The reflection of fluid off the baffle attenuates the noise created by the compressor. This type of muffler may be attached at or near the discharge of the compressor to provide noise attenuation for the compressor system.

In operation, the compressor works the fluid to achieve a high pressure at the discharge. However, when the compressor is no longer operating, the fluid present in the HVAC refrigerant loop on the high pressure side of the compressor (i.e., the side of the compressor toward the condenser in the HVAC loop) flows in a direction toward the low pressure side of the compressor (i.e., the side of the compressor toward the evaporator in the HVAC loop) until a state of equilibrium between the formerly high and formerly low pressure sides is achieved. Thus, the high pressure side equalizes with the low pressure side when the compressor stops operating. However, during the time in which the fluid is equalizing, the fluid flows through the compressor and over the compression members in a direction that is opposite the direction that the fluid flows during compressor operation. For example, in a screw compressor, when the fluid rushes to the low pressure side of the compressor, the fluid passes over the rotors of the screw compressor. This backflow of fluid causes the rotors to spin in the opposite direction of normal operation at a high rate of speed creating an undesirable sound level and frequency.

What is needed is a device and/or method that substantially prevents the rush of fluid from the high pressure side to the low pressure side when the compressor stops operating and/or reduces the amount of noise created when the compressor is deactivated.

SUMMARY OF THE INVENTION

The present invention is directed to a compressor muffler includes a housing having an inlet end and an outlet end. A baffle arrangement extends from an interior surface of the housing. The baffle arrangement includes a surface capable of reflecting compressed fluid to attenuate noise. A valve assembly is disposed inside the baffle arrangement. The valve assembly is positionable between a first position and a second position. The valve assembly also includes a valve surface that at least partially prevents flow of fluid through the housing from the outlet end when the valve assembly is in the first position.

Another embodiment of the present invention includes a hollow muffler body having an inlet end and an outlet end. The hollow muffler body includes a baffle and one or more baffle tubes disposed in the hollow muffler body. A valve member is disposed in the one or more baffle tubes. The valve member is positionable between a first position and a second position. Fluid flow through the hollow muffler body is at least partially prevented by a valve surface of the valve member when the valve member is in the first position.

Another embodiment of the present invention includes a valve assembly for use in a compressor muffler having a hollow body having an inlet end and an outlet end. The outlet end of the cylindrical body includes at least one opening and a cap member configured and disposed to at least partially prevent axial flow of fluid through the cylindrical body and reflect fluid to attenuate sound. The cylindrical body is positionable in a first position that permits flow of fluid from the inlet end to the outlet end and is positionable in a second position that at least partially prevents flow from the outlet end to the inlet end when the hollow body is disposed in a baffle tube of a muffler.

The structures of the present invention include mufflers attached to the discharge of the compressor, including screw compressors. The device for preventing at least a portion of the backflow of fluid in a valve assembly may include piston assembly that moves from an open position to a closed position, depending on the direction of flow of fluid. The piston allows flow through the valve assembly when in the open position and prevents at least a portion of the flow when the piston moves to the closed position. The piston moves to the open position when the compressor is operating, to permit the compressed fluid to flow through the valve assembly. The piston within the valve assembly is movable to the closed position when the compressor stops operating, to prevent backflow of the compressed fluid through the valve assembly toward the compressor inlet. When the piston is in the closed position, the amount of flow prevented by the piston is sufficient to prevent the compression members of the compressor from rotating in the opposite direction of operation at a high rate of speed.

One advantage of the present invention is that the prevention of flow in the opposite direction of normal operation reduces or eliminates rotation of the compression members of the compressor in the opposite direction and the resultant undesirable sound level and frequency.

Another advantage of the present invention is that the placement of the valve structure inside the muffler is less expensive than providing a separate check valve (i.e., one-way valve) in the discharge line.

Another advantage of the present invention is that the installation of the valve structure external to the compressor eliminates the need to machine or modify the compressor.

Another advantage of the present invention is that perfect seating of the valve is not required because the flow in the opposite direction need not be stopped entirely in order for the reduction or elimination of the rotation of the compression members in the opposite direction of operation to occur.

Another advantage of the present invention is that the valve is self-contained inside the baffle, which is a stationary component. The baffle can be welded into the muffler shell with some misalignment between the axis of the components, and the operation of the valve will not substantially be effected.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

The refrigeration or HVAC system according the present invention includes a compressible fluid, an evaporator, a compressor, a condenser, and an expansion device. In the refrigeration cycle, the fluid begins in a liquid state under low pressure. The evaporator evaporates the low pressure liquid, and the liquid becomes a low pressure vapor. The compressor draws the vapor in and compresses it, producing a high pressure vapor. The compressor then passes the high pressure vapor to the condenser. The condenser condenses the high pressure vapor, generating a high pressure liquid. The cycle is completed when the expansion device expands the high pressure liquid, resulting in a low pressure liquid. By means of example only, the fluid may be any suitable refrigerant including, but not limited to R-410A, R-407C, ammonia, or ethyl chloride.

Figure 1A:
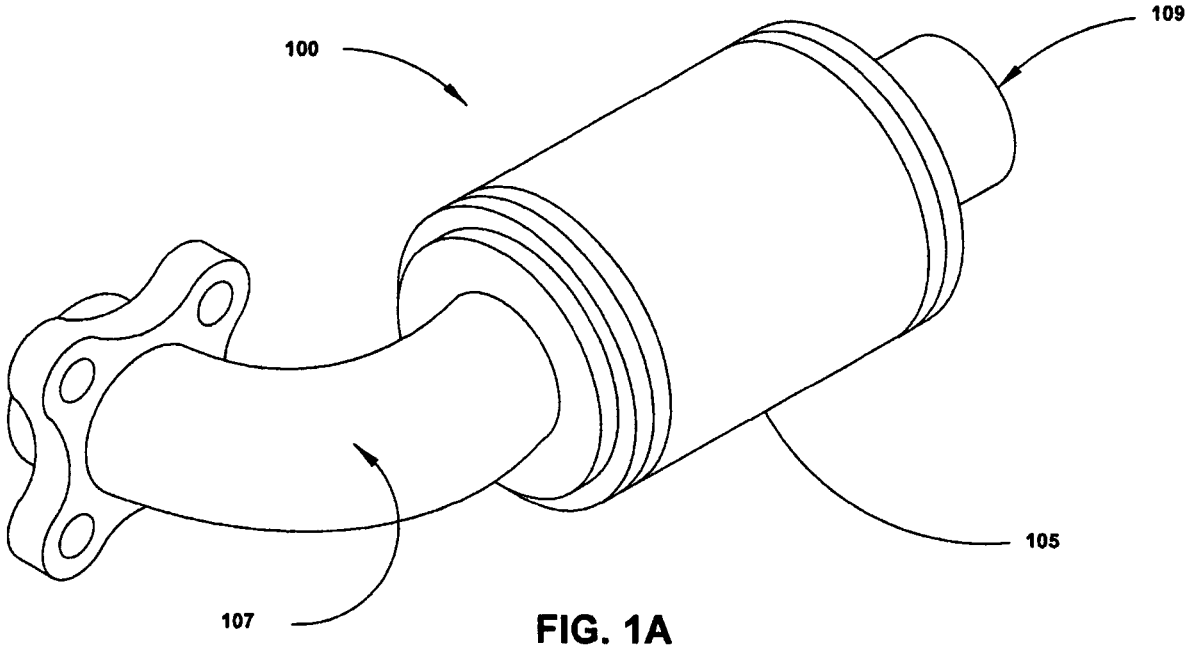
FIG. 1A illustrates a perspective view of a muffler according to an embodiment of the present invention for attachment to a compressor.

FIG. 1A illustrates generally a muffler assembly 100 for attachment to the discharge of a compressor. The muffler assembly 100 includes an inlet end 107 and an outlet end 109. The muffler assembly 100 includes a hollow, substantially cylindrical muffler body 105 positioned between the inlet end 107 and the outlet end 109.

Figure 1B:
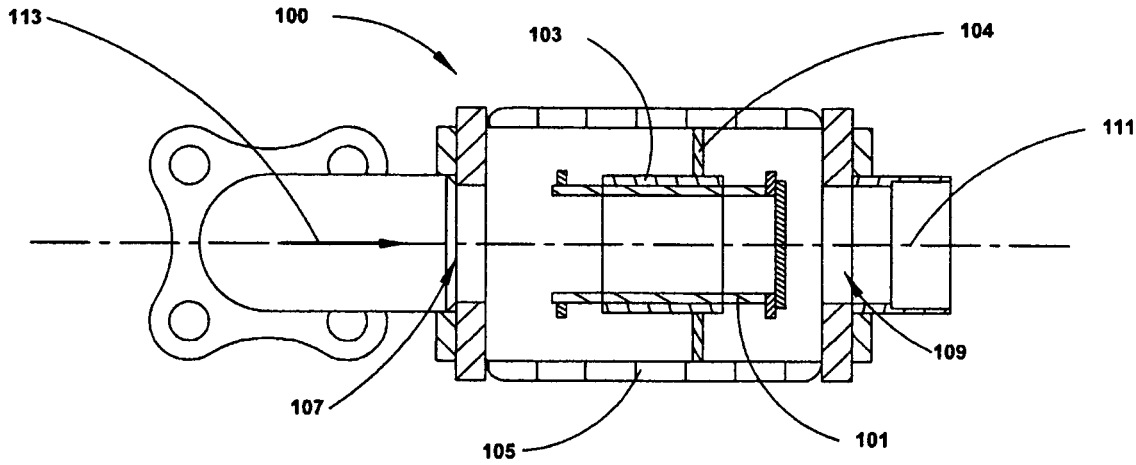
FIG. 1B illustrates a cutaway view of a muffler for attachment to a compressor having the piston assembly according to an embodiment of the present invention positioned inside the baffle of the muffler.

FIG. 1B illustrates a cutaway view of the muffler assembly 100. The inner surface of the muffler body 105 includes a baffle ring 104 having an outer circumference that is attached to the muffler body 105 along an inner circumference of the muffler body 105. A baffle tube 103 is attached to the baffle ring 104 along an inner circumference of the baffle ring 104. The baffle ring 104 and the baffle tube 103 may include any suitable geometry that provides the desired noise attenuation for the muffler assembly 100. Likewise, one end of the baffle tube 103 may extend for a length from one surface of the baffle ring 104 and terminate at a plane defined by baffle ring 104 or may extend for a length on each side of the baffle ring 104. The baffle tube 103 and the baffle ring may be separate components attached to each other or may be fabricated as a single integral component having a baffle ring 104 structure and a baffle tube 103 structure. The baffle tube 103 and the muffler body 105 are both substantially cylindrical and are oriented about substantially the same center axis 111 (i.e., the tube and body are coaxial). The muffler assembly 100 may be attached to a compressor (not shown) at the inlet end 107. During compressor operation, fluid may flow into the muffler assembly through the inlet end 107, shown as flow 113.

Figure 2A:
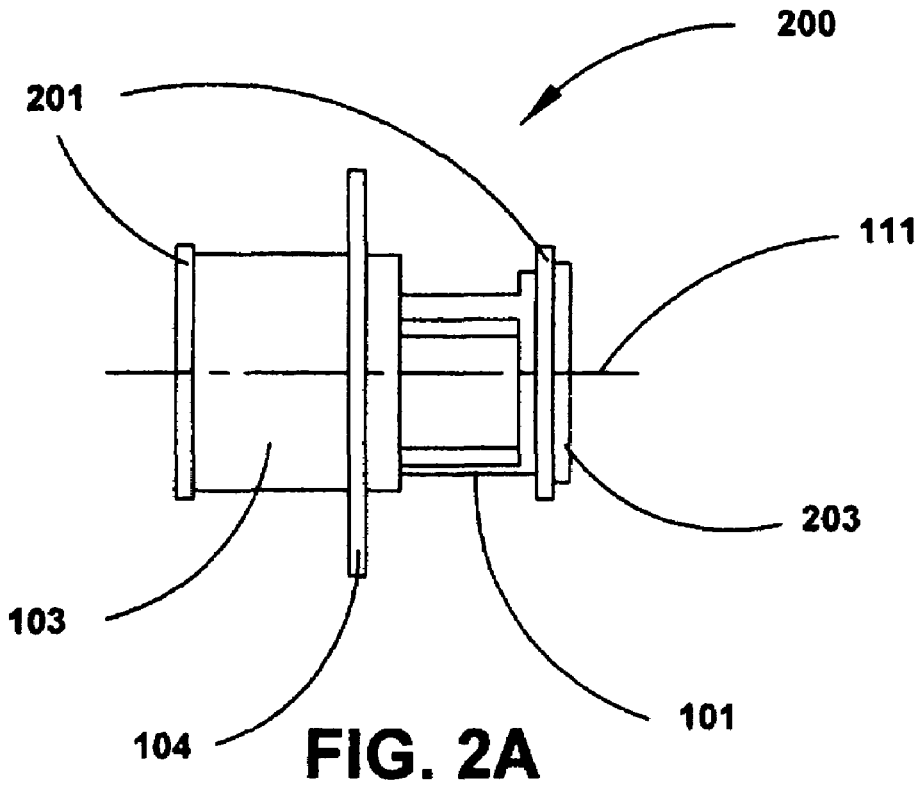
FIG. 2A illustrates a side view of the piston assembly inside the baffle of the muffler according to an embodiment of the present invention.
Figure 2B:
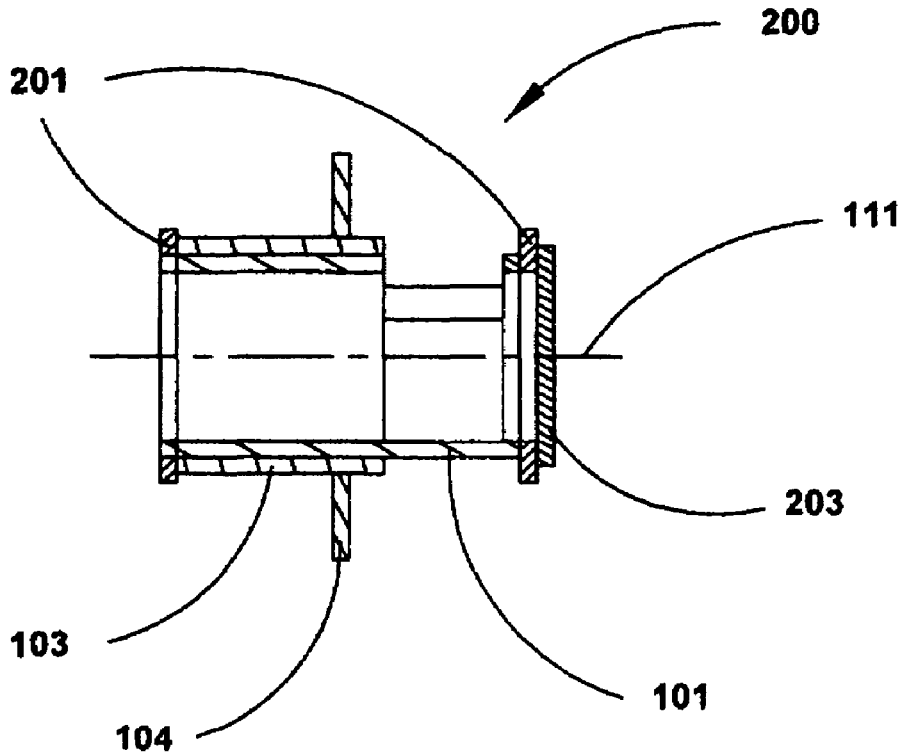
FIG. 2B illustrates a cutaway view of the piston assembly inside the baffle of the muffler according to an embodiment of the present invention.

FIG. 2A provides a side view and FIG. 2B provides a cutaway view that illustrate generally a piston/baffle assembly 200 wherein the piston/baffle assembly 200 includes a piston assembly 101 having a substantially cylindrical shape positioned inside the baffle tube 103 and the baffle ring 104. The baffle tube 103, the baffle ring 104 and the piston assembly 101 are coaxial about center axis 111. The piston assembly 101 includes stop rings 201 at substantially opposite ends of the piston assembly 101. The stop rings 201 extend outwardly from the piston assembly 101 and are positioned on the piston assembly 101 so as to limit movement of the piston assembly 101 along the center axis 111. Each of the stop rings 201 can abut an end of the baffle tube 103 and/or baffle ring 104 to limit the axial movement of the piston assembly 101 inside the baffle ring 104 and baffle tube 103. The piston assembly 101 includes a piston cap 203 at one end. The piston cap 203 may be a substantially solid disk that is attached to the piston assembly 101 near one of the stop rings 201 so that the piston cap 203 substantially prevents flow of fluid when the stop ring 201 near the piston cap 203 abuts the baffle tube 103 and/or baffle ring 104. The length of the piston assembly 101 within the baffle tube 103 is such that during the operation of the muffler assembly 100, piston assembly 101 does not interfere with the noise attenuation or fluid flow through the muffler. For example, the length of the piston assembly 101 is sufficiently long to expose openings 307 when the piston assembly 101 is the open position to permit efficient operation of the valve, and is sufficiently short to prevent restriction or blockage of the flow of gas through the valve by not restricting or blocking the inlet and/or outlet flow from the muffler body 105. In addition, the length of the piston assembly should be proportional to the muffler 100 in order to allow gas flow through the piston assembly 101 when the piston assembly 101 is in the open position with a minimal amount of pressure drop.

Figure 3A:
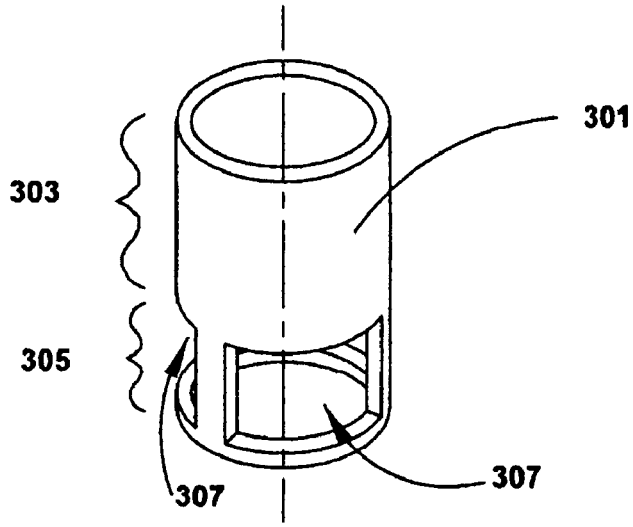
FIG. 3A illustrate a perspective view of the piston tube body according to an embodiment of the present invention.
Figure 3B:
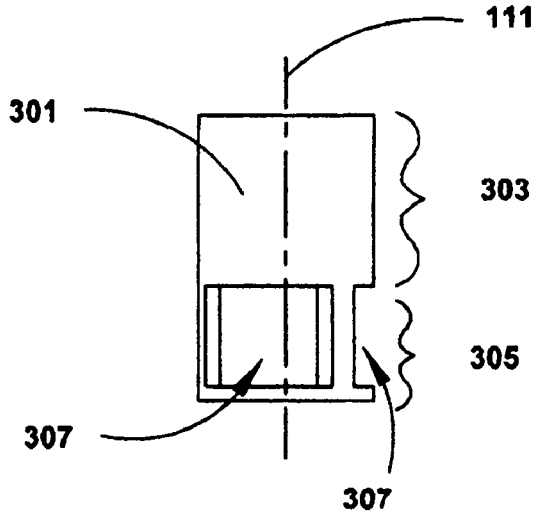
FIGS. 3B and 3C illustrate side views of the piston tube body according to an embodiment of the present invention.
Figure 3C:
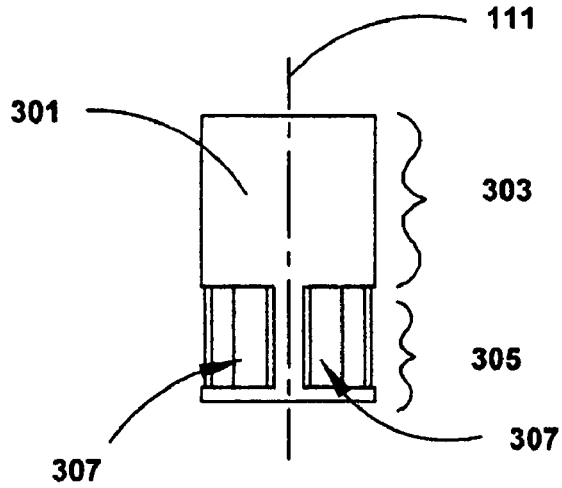

FIGS. 3A, 3B and 3C illustrate generally a piston tube body 301 that is suitable for the position assembly 101. FIG. 3A shows a perspective view of the piston tube body 301. FIGS. 3B and 3C show side views of the piston tube body 301. The piston tube body 301 may include two portions extending along the length of the piston tube body 301 cylinder. The first portion 303 is a solid portion wherein this portion of the cylinder is solid and does not allow any radial flow of fluid. The second portion 305 of the cylinder is a perforated portion that includes at least one opening 307 to allow the passage of fluid in a radial direction. Openings 307 preferably have a total open area that permits flow when the piston assembly 101 is in the open position that is at least as large as the total area of the cross-section of the piston tube body 301 in order to reduce or prevent fluid pressure drop through the piston assembly 101. Although FIGS. 3A, 3B and 3C include piston tube bodies 301 having a first portion 303 and a second portion 305, a piston tube body 301 is not limited to a structure having these two portions. Any combinations of openings 307 may be provided in the piston tube body 301 of the present invention so long as fluid is permitted to pass through the piston tube body when the valve assembly is in an open position. Suitable structures for the piston tube body 301 include perforated structures, such as screen material or slotted material, which may extend for the entire length of the piston tube body 301. Suitable screen material or slotted material preferably includes openings 307 with a total open area that permits flow when the piston assembly 101 is in the open position that is at least as large as the total area of the cross-section of the piston tube body 301 in order to reduce or prevent fluid pressure drop through the piston assembly 101.

Figure 4A:
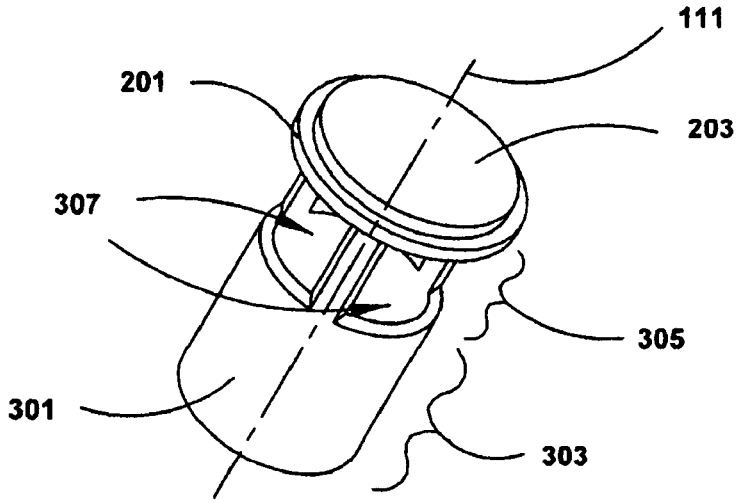
FIG. 4A illustrates a perspective view of the piston tube body with a stop ring and piston cap according to an embodiment of the present invention.
Figure 4B:
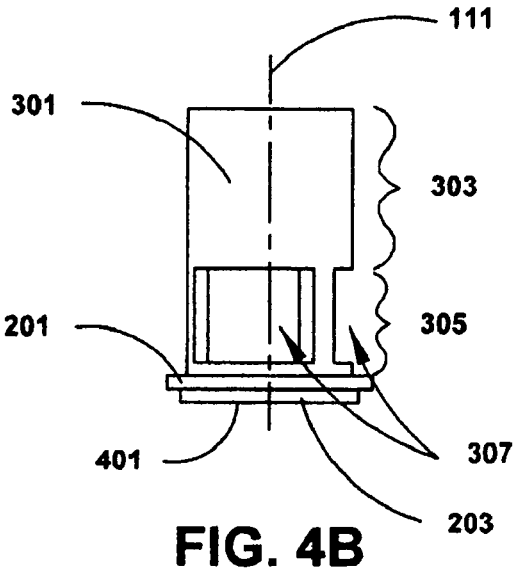
FIGS. 4B and 4C illustrate side views of the piston tube body with a stop ring and piston cap according to an embodiment of the present invention.
Figure 4C:
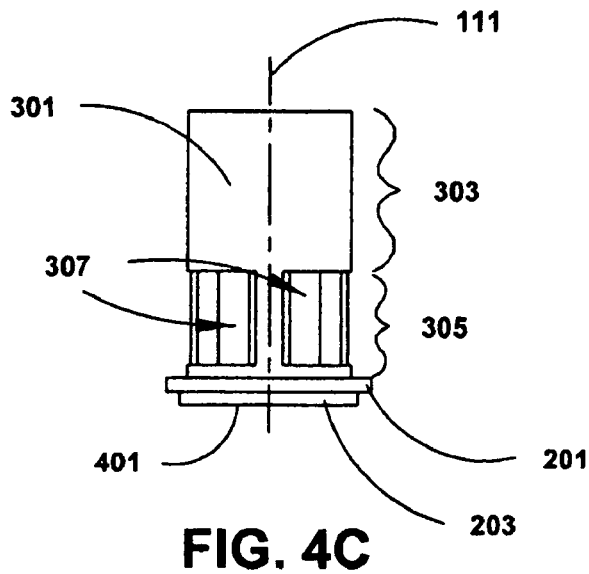

FIGS. 4A, 4B and 4C illustrate generally a piston tube body 301, as shown in FIGS. 3A, 3B and 3C, with a stop ring 201 and a piston cap 203. The stop ring 201 and piston cap 203 are attached to the piston tube body 301 at one end of the piston tube body 301, preferably, the second portion 305 of the piston tube body 101. The piston cap 203 provides a surface 401 that at least partially prevents the flow of fluid when the piston assembly is in a closed position. Although FIGS. 3A, 3B, 3C, 4A, 4B and 4C depict a piston assembly 101 having a separate piston tube body 301 and piston cap 203, the piston assembly may be fabricated as in single integral piece, so long as the piston assembly 101 includes a piston tube body 301 structure capable of sliding within the baffle tube 103 and a piston cap 203 structure capable of at least partially preventing the flow of fluid. The piston assembly 101 may be fabricated from any suitable material, including, but not limited to, metal or other material capable of withstanding the valve cycling and the conditions within the muffler 100.

Figure 5A:
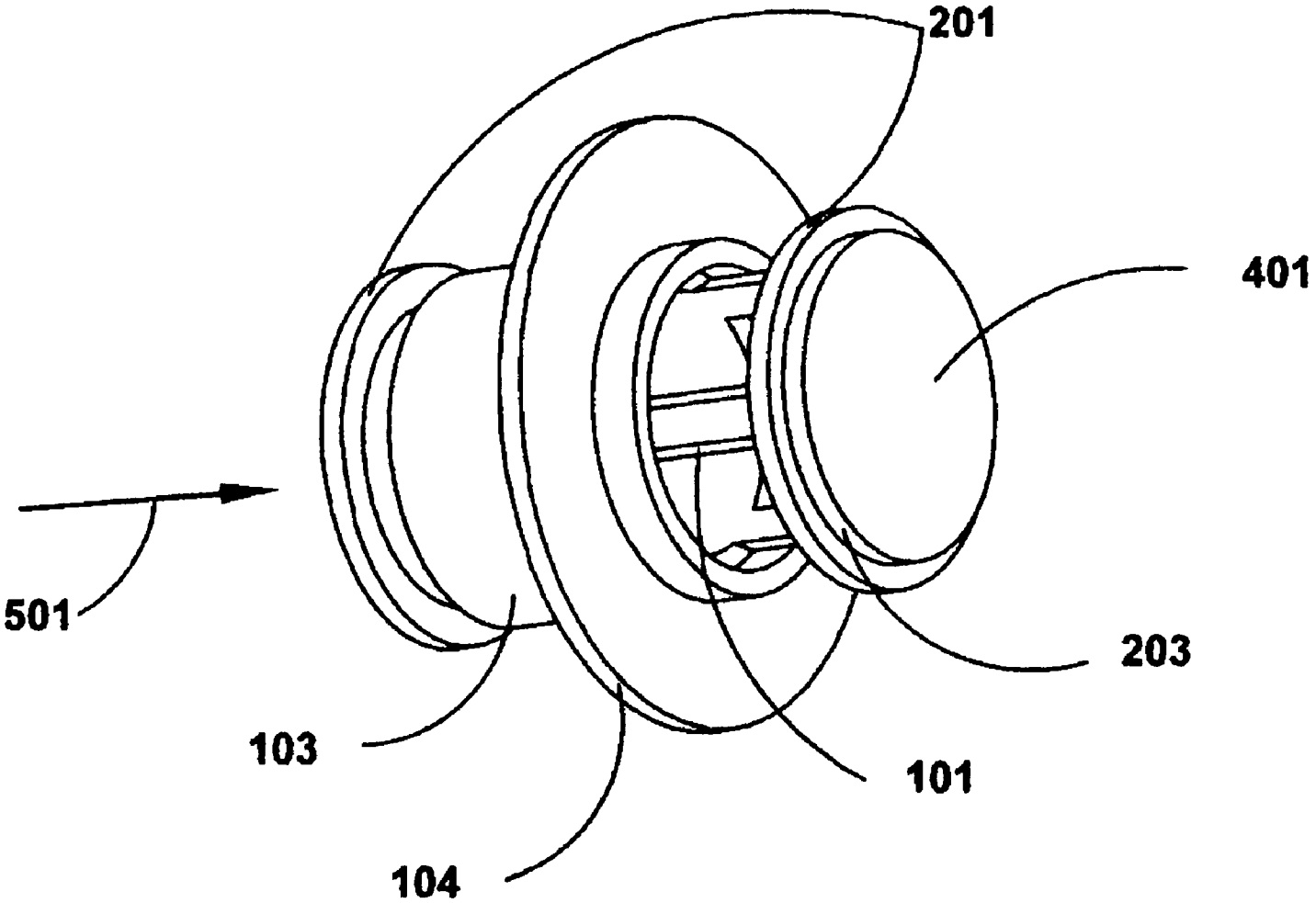
FIG. 5A illustrates a perspective view of the piston assembly inside the baffle of a muffler when the piston is in an intermediate position according to an embodiment of the present invention.
Figure 5B:
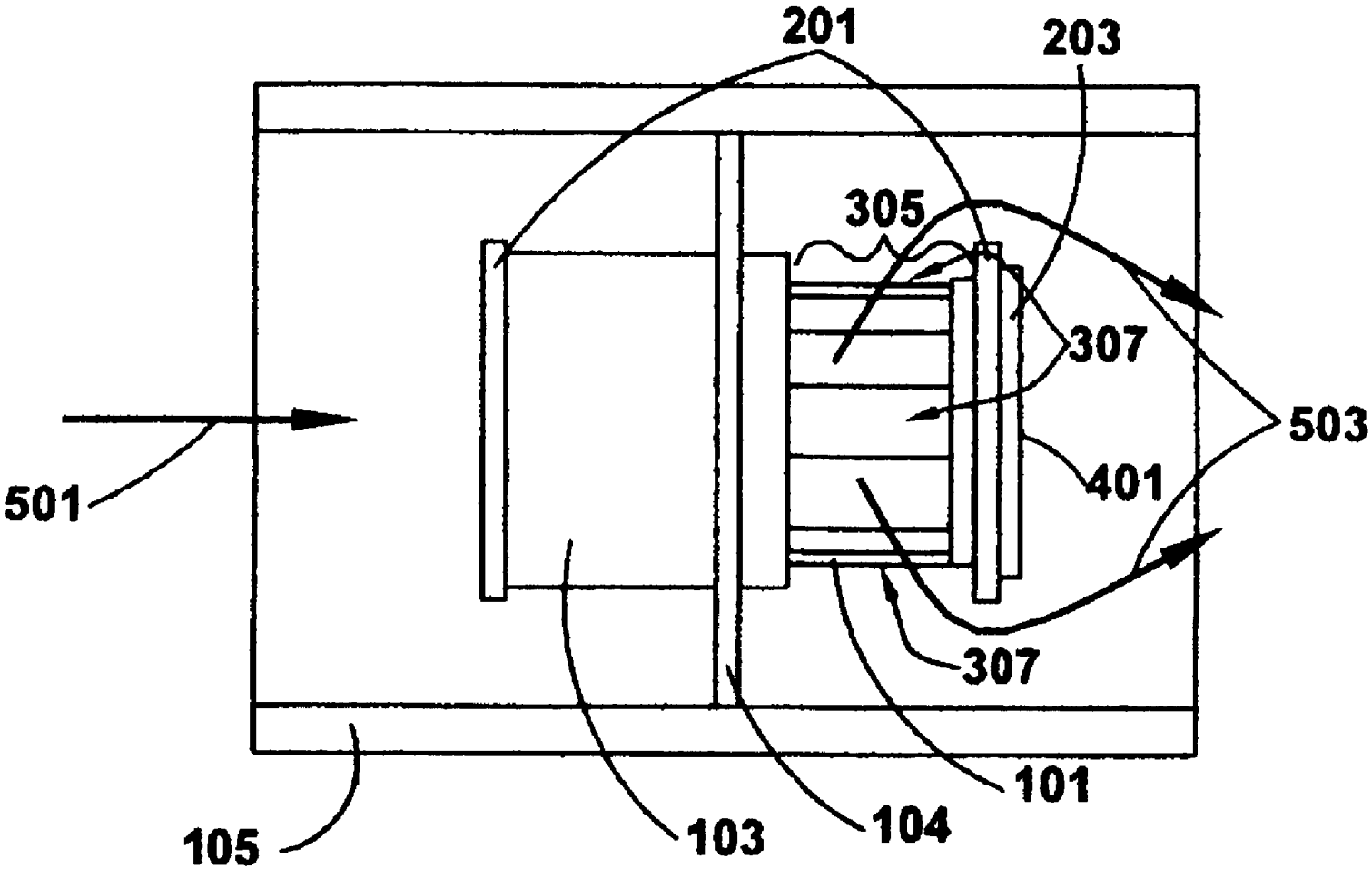
FIG. 5B illustrates a perspective view of the piston assembly inside the baffle of a muffler and the muffler body when the piston is in an open position according to an embodiment of the present invention.
Figure 5C:
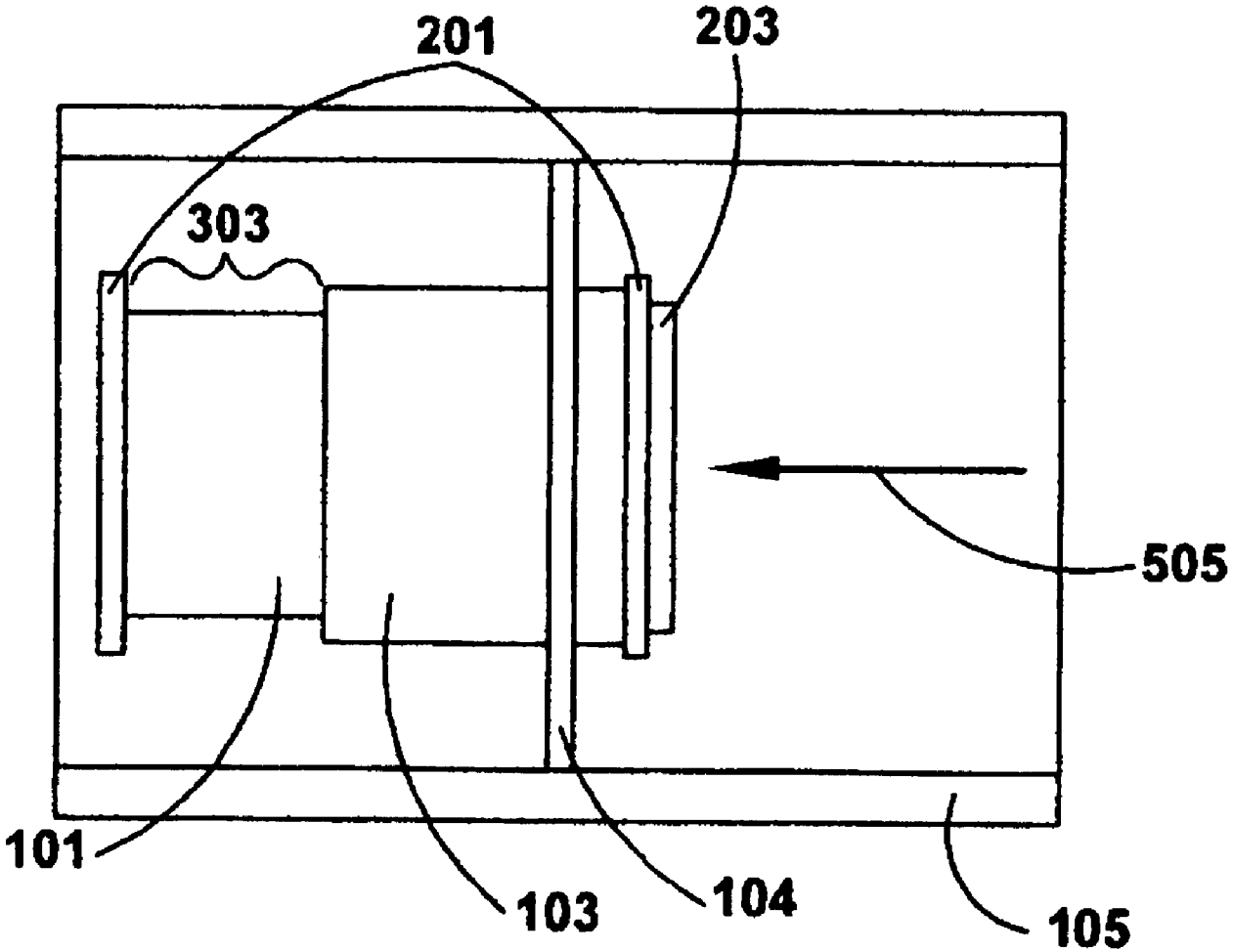
FIG. 5C illustrates a perspective view of the piston assembly inside the baffle of a muffler and the muffler body when the piston is in an closed position according to an embodiment of the present invention.

FIGS. 5A, 5B and 5C illustrate the operation of the piston assembly 101. FIG. 5A shows the piston assembly 101 in an intermediate position wherein the stop rings 201 do not abut the baffle tube 103 or the baffle ring 104. During compressor operation, the fluid flow 501 from the compressor enters the piston assembly 101 at the end of the piston tube body 301 opposite the end of the piston tube body 301 having the piston cap 203. The fluid flow 501 travels through the piston assembly 101 and contacts an interior surface of the piston cap 203 providing a force that is capable of sliding the piston assembly 101 in a direction that positions openings 307 outside of baffle tube 103 and baffle ring 104, i.e., the piston assembly 101 is moved toward an open position (see FIG. 5B).

FIG. 5B shows the piston assembly 101 inside the muffler body 105 in a fully open position where the stop ring 201 at the end of the piston assembly 101 opposite the end having piston cap 203 abuts the baffle tube 103. During compressor operation, fluid flow 501 from the compressor enters the piston assembly 101 at the end of the piston tube body 301 opposite the end of the piston tube body 301 having the piston cap 203. The fluid flow 501 travels into the piston assembly 101 and contacts an interior surface of the piston cap 203 providing a force that maintains the piston assembly 101 in the fully open position shown in FIG. 5B. The fluid flow 503 exits the piston assembly 101 through openings 307 in the second portion 305 of the piston tube body 301. When the compressor is deactivated, the flow of fluid reverses and the fluid attempts to flow in a direction toward the low pressure side of the compressor (i.e., the side of the compressor toward the evaporator in the HVAC loop) until a state of equilibrium between the formerly high and formerly low pressure sides is achieved. The now backwards flowing fluid contacts surface 401 and provides a force that slides the piston assembly 101 from the fully open position, as shown in FIG. 5B to a closed position (see FIG. 5C), where the openings 307 are located within the baffle tube 103 and baffle ring 104.

FIG. 5C shows the piston assembly 101 inside the muffler body 105 in a closed position where the stop ring 201 at the end of the tube body 301 having the piston cap 203 abuts the baffle tube 103 and/or the baffle ring 104. The fluid flow 505 resulting from compressor deactivation flows toward the end of the piston assembly 101 having the piston cap 203. The fluid flow 505 is substantially prevented from entering piston assembly 101 by stop ring 201 and piston cap 203.

The operation of the piston assembly 101 includes three states. First, the piston assembly 101 can be fully open to allow flow through the assembly (as illustrated by FIG. 5B). Second, the piston assembly 101 can be in the closed position so that the flow is substantially prevented (as illustrated by FIG. 5C). Third, the piston assembly 101 may be in an intermediate position at any point in between the fully open and closed position (as illustrated by FIG. 5A).

In one embodiment, the muffler assembly 100 is placed on the discharge of a compressor. The compressor is preferably a screw compressor, but may be any type of compressor (e.g. reciprocating, rotary, scroll or centrifugal) that may use a muffler. Preferably, the compressor is component of an HVAC system or refrigeration system but the muffler assembly 100 can be used with any suitable system incorporating a compressor. When the compressor is not operating, the piston assembly 101 is in the closed position, as shown in FIG. 5C. When the compressor begins to run, the fluid pressure begins to build in the discharge line. When the fluid pressure reaches a certain level, a force is provided sufficient to slide the piston assembly 101 axially inside the baffle tube 103 and the baffle ring 104, as shown in FIG. 5A, to a fully open position (see FIG. 5B). The flow of fluid 501 continues to provide a force that moves the piston assembly 101 until the stop ring 201 seats against the baffle tube 103, as shown in FIG. 5B, i.e., the fully open position. The fluid then travels through the center of the piston and exits through at least one opening 307 in the piston tube body 301. The fluid exiting the piston assembly 101 then flows through the outlet end 109 of the muffler assembly 100.

When the compressor stops running, the differential pressure between the discharge side of the screw rotors and the suction side of the screw rotors attempts to equalize and the fluid begins to flow in the opposite direction. During the operation of the compressor, the flow of fluid is from the inlet end 107 to the outlet end 109 of the muffler assembly 100. After deactivation of the compressor, the flow reverses and attempts to flow from the outlet end 109 to the inlet end 107 of the muffler assembly 100 (shown as flow 505 in FIG. 5C). This backwards flow places pressure against surface 401 of the piston cap 203 of the piston assembly 101 which causes the piston assembly 101 to move axially inside the baffle tube 103 and the baffle ring 104 toward the compressor. The piston assembly 101 stops moving when the stop ring 201 of the piston assembly 101 seats against a surface of the baffle ring 104 and/or baffle tube 103 as shown in FIG. 5C. This seat substantially prevents a rush of fluid flow through the compressor that causes the screw rotors to rotate in reverse at a high rate of speed, and thereby reduces or eliminates the undesirable noise created by such a reverse rotation of the screw rotors.

The piston assembly 101 need not prevent all of the flow of fluid when in the closed position. The piston assembly 101 only has to prevent flow sufficient to prevent the turning of the screw rotors in the reverse direction at a high rate of speed. Therefore, the piston cap 203 need not seat completely with the baffle tube 103 and/or baffle ring 104. The pressure differential in the system may equalize via leakage around the seat. Once the compressor begins operation again, the cycle is repeated. In another embodiment of the invention, the baffle ring 104 may also include perforations or openings to further facilitate pressure equalization when the compressor is deactivated and the piston assembly 101 is in the closed position.

In another embodiment of the invention, the piston cap 203 is provided with at least one opening. The providing of openings in the piston cap 203 allow for greater control over the pressure drop across the muffler. The openings allow at least some fluid to travel through the piston cap 203, both during operation of the compressor and during times of shut down. The openings provide sufficient additional flow during operation to decrease the pressure drop in the muffler assembly 100 during operation. However, the openings in the piston cap 203 are arranged and disposed such that, during shutdown of the compressor, the high flow rates are substantially prevented in the opposite direction of normal operation and can be controlled to a desired flow rate.

The piston assembly 101 provides a pressure drop across the muffler assembly 100 that is substantially equal to a pressure drop in a muffler having no piston assembly 101. The geometry of the muffler assembly 100, according to an embodiment of the invention, is such that the area of fluid passage gets progressively larger as the fluid flows through the piston assembly 101 and toward outlet 109. The increased area causes a decrease in pressure drop of the fluid as it travels through the muffler 100 and valve assembly. The smallest area for fluid passage is the entrance into the piston assembly 101. The next larger area for fluid passage is the exit through the second portion 305 of the piston assembly 101. The next larger area for fluid passage is the area around the space created between the piston cap 203 and the inside of the muffler body 105. The largest area for fluid passage is the area remaining between the piston cap 203 and the end of the muffler body 105. As the fluid exits the muffler assembly 100 via outlet 109, the pressure drop at the outlet 109 is such that the total pressure differential over the muffler assembly is minimized. Therefore, due to the increase in the fluid passage area through the muffler body 105, the pressure drop across the muffler assembly 100 with the piston assembly 101 is not appreciably different than the pressure drop across a muffler with no piston assembly 101.

In order to attenuate sound, fluid entering the muffler assembly 100 is reflected off the baffle ring 104 inside the muffler body 105. The baffle ring 104 includes a surface substantially perpendicular to the flow of fluid through the muffler assembly 100. When fluid is reflected off the baffle ring 104, at least some noise attenuation is achieved. The present invention provides an additional surface (i.e., a surface of the piston cap 203) that is also substantially perpendicular to the flow of fluid passing through the muffler assembly 100 and the piston assembly 101. Fluid passing through the piston assembly 101 may reflect off the piston cap 203. The reflection off the piston cap 203 may provide additional noise attenuation.

The piston assembly 101 is inside a muffler assembly 100 that is preferably part of an HVAC system. The integration of the piston assembly 101 into the muffler assembly 100 provides a means for preventing the high flow rates of fluid in the opposite direction of normal operation. The integration of the piston assembly 101 into the muffler assembly 100 involves less equipment and is less expensive than purchasing and installing a one-way valve in the discharge line of the compressor.

The integration of the piston assembly 101 into the external muffler assembly 100 of the compressor discharge allows the control of the high flow rates in the opposite direction of normal operation without the need to machine or modify the compressor. The piston assembly 101 and muffler assembly 100 are external to the compressor and can easily be replaced with no need to service the compressor. The muffler assembly 100 with a piston assembly 101 of the present invention may also allow a compressor to operate without an internal one-way valve.

The muffler assembly 100 can be manufactured easily because perfect seating and perfect alignment of the piston assembly 101 is not required. The piston assembly 101 is self-contained inside the baffle ring 104, which is a stationary component. The baffle ring 104 may be welded into the muffler body 105 with some misalignment between the axis of the components. Some misalignment does not prevent the operation of the piston assembly 101. The piston assembly 101 need not stop all of the flow when in the closed position. Therefore, perfect seating and perfect alignment of the piston assembly 101 is not required, providing for easy installation.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A compressor muffler comprising:

a housing having an inlet end and an outlet end;

a baffle arrangement extending from an interior surface of the housing, the baffle arrangement comprising a surface capable of reflecting compressed fluid to attenuate noise;

a valve assembly being disposed inside said baffle arrangement, the valve assembly being positionable between a first position and a second position, the valve assembly further comprising a valve surface that at least partially prevents flow of fluid through the housing from the outlet end to the inlet end when the valve assembly is in the first position by contacting the baffle arrangement; and wherein the valve assembly includes one or more openings permitting fluid flow through the valve assembly when the valve assembly is in the second position and wherein the openings have a total open area at least as large as a total cross-sectional area of the valve surface; and wherein the baffle arrangement is disposed to direct fluid flow substantially axially when fluid is passing through the baffle arrangement.

2. The muffler of claim 1, wherein the prevention of fluid flow from the outlet end to the inlet end by the valve assembly being in the first position limits undesirable noise resulting from a compression member rotating in a direction opposite to a direction of rotation during compressor operation.

3. The muffler of claim 1, wherein the valve assembly is disposed in the second position when the compressor is operating, the valve assembly being positionable in the second position by a flow of fluid entering the inlet end.

4. The muffler of claim 1, wherein the valve assembly is disposed in the first position when the compressor is deactivated, the valve assembly being positionable in the second position by a flow of fluid entering the outlet end.

5. The muffler of claim 1, wherein the valve assembly comprises a cylindrical member, the cylindrical member is configured to slide within the baffle arrangement between the first position and the second position.

6. The muffler of claim 1, wherein the valve assembly further comprises a stop member configured to position the valve assembly in one of the first position or the second position.

7. The muffler of claim 1, wherein the valve surface is arranged and disposed to reflect fluid traveling from the inlet end to provide noise attenuation.

8. The muffler of claim 1, wherein the valve surface includes one or more openings to permit at least some fluid flow from the outlet end to the inlet end to equalize the pressure across the housing when the valve assembly is in the first position.

9. A compressor muffler comprising:

a hollow muffler body having an inlet end and an outlet end, the hollow muffler body comprising a baffle and one or more baffle tubes disposed in the hollow muffler body;

a valve member being disposed in the one or more baffle tubes, the valve member being positionable between a first position and a second position;

wherein fluid flow through the hollow muffler body is at least partially prevented by an end cap of the valve member at least partially covering the one or more baffle tubes when the valve member is in the first position, the one or more baffle tubes disposed to direct fluid flow substantially axially when fluid is passing through the baffle arrangement; and wherein the valve member includes one or more openings permitting fluid flow through the valve member when the valve member is in the second position and wherein the openings have a total open area at least as large as a total cross-sectional area of the end cap.

10. The muffler of claim 9, wherein the prevention of fluid flow from the outlet end to the inlet end by the valve member being in the first position limits undesirable noise resulting from a compression member rotating in a direction opposite to a direction of rotation during compressor operation.

11. The muffler of claim 9, wherein the valve member is disposed in the second position when the compressor is operating, the valve member being positionable in the second position by a flow of fluid entering the inlet end.

12. The muffler of claim 9, wherein the valve member is disposed in the first position when the compressor is deactivated, the valve member being positionable in the second position by a flow of fluid entering the outlet end.

13. The muffler of claim 9, wherein the valve member comprises a cylindrical body, the cylindrical body is configured to slide within the baffle arrangement between the first position and the second position.

14. The muffler of claim 9, wherein the valve member further comprises a stop member that is configured to position the valve member in one of the first position or the second position.

15. The muffler of claim 9, wherein the end cap includes one or more openings to permit at least some fluid flow from the outlet end to the inlet end to equalize the pressure across the housing when the valve member is in the first position.

* * * * *